US005671857A

United States Patent [19]

Stromberg

[11] Patent Number: 5,671,857

[45] Date of Patent: Sep. 30, 1997

[54] COLLAPSIBLE CONTAINER

[75] Inventor: Per Sigmund Stromberg, Lillestrom, Norway

[73] Assignee: Strombergs Plast A.S., Strommen, Norway

[21] Appl. No.: 572,970

[22] Filed: Dec. 15, 1995

Related U.S. Application Data

[63] Continuation of Ser. No. 211,830, Apr. 18, 1994, Pat. No. 5,501,354.

[30] Foreign Application Priority Data

May 26, 1992 [GB] United Kingdom ..... 9211112

[51] Int. Cl.[6] ..... B65D 7/22

[52] U.S. Cl. ..... 220/7; 206/517; 206/505; 220/771

[58] Field of Search ..... 220/7, 771; 206/517, 206/505

[56] References Cited

U.S. PATENT DOCUMENTS

| | | | |
|---|---|---|---|
| 3,195,770 | 7/1965 | Robertson | 206/518 |
| 3,279,648 | 10/1966 | Worthington | 206/517 |
| 3,759,416 | 9/1973 | Constantine | 206/505 |
| 3,900,157 | 8/1975 | Roth | 220/7 |
| 3,904,066 | 9/1975 | Wilson | 220/7 |
| 4,079,852 | 3/1978 | Stoffregen | 220/7 |
| 4,673,087 | 6/1987 | Webb | 206/517 |

FOREIGN PATENT DOCUMENTS

| | | | |
|---|---|---|---|
| 1247340 | 11/1968 | United Kingdom | 220/7 |

*Primary Examiner*—Joseph M. Moy
*Attorney, Agent, or Firm*—Erwin Doerr

[57] ABSTRACT

A blank for a collapsible container formed from a single molding of plastics material and comprising a bottom wall, side-and end wall panels hinged to the bottom wall so that the wall panels can be erected from a collapsed to an upright position, and complementary locking member provided at adjacent end portions of the side-and end wall panels for securing the wall panels in upright position, the blank being adapted to be stacked unto like blanks for shipment and storage, the wall panels include formations which project beyond the interior surfaces of the wall panels and corresponding recesses are provided on the exterior surfaces of the wall panels and arranged to receive the projecting formations of a like blank positioned below.

1 Claim, 6 Drawing Sheets

COLLAPSIBLE CONTAINER

This application is a continuation of application Ser. No. 08/211,830, filed Apr. 18, 1994, now U.S. Pat. No. 5,501, 356.

This invention relates to a collapsible container and particularly, although not exclusively, a container for the shipping of perishable goods such as fish. A container according to this invention is formed from a single molding of a plastics material such as polyethylene to form a box or transparent case which comprises a bottom panel and first and second pairs of like wall panels hingedly connected to the bottom panel. A lid or cover may be provided preferably as a separate item to close the open top of the box. Containers according to the invention may also be stacked one upon the other so that it is often unnecessary to provide a lid for each container.

Non-collapsible cases with insulating properties for shipping fish and formed from expanded or foamed polystyrene are known but these known cases are not returnable and have become regarded by virtue of their composition, as being environmentally unacceptable.

Such containers do have the advantage of low cost. A collapsible, returnable and reusable container is desirable for the shipping of fresh (chilled) or frozen fish. A unitary knockdown foamed polystyrene shipping container is known from U.S. Pat. No. 3,675,808 but is not robust enough for repeated return (round-trip) journeys. Moreover, the foamed material, at least to some extent, absorbs fluids and would on this count alone be unsuitable as a reusable fish box. U.S. Pat. 4,235,346 discloses a light weight, collapsible shipping container having a unitary molded construction in which a bottom panel is integrally hinged to four peripheral side panels and a top panel is hinged to one of the side panels. However, this container is also intended to be formed from a foamed plastics material and is unsuitable for use as a reusable fish box for the reasons given above.

Collapsible containers having a more robust and acceptable composition are known from e.g. U.S. Pat. No. 4,005, 975 which discloses a container formed from a unitary blank of polypropylene in which side panels are integrally hinged to a bottom panel. There are provisions to lock together with side end panels when they are brought into an upright position comprising stud and socket connections. However, the particular arrangement disclosed is insufficiently secure in view of the anticipated static and impact loading imposed upon a container according to the present invention utilized as a shipping container for fish. U.S. Pat. No. 3,675,808 discloses a collapsible box in which the side and end panels are secured together by means of a dovetail type tongue and recess.

The present invention seeks to achieve a robust but relatively low cost collapsible, returnable and reusable shipping container which for return shipment, can be put into nested superposed relationship with like containers, when collapsed so that the height and space occupied by a stack of collapsed containers is minimized.

The present invention provides a collapsible container for use in the shipping of goods, including perishable goods, and comprises a single molding of a plastics material to form an open-topped box which comprises a bottom panel and first and second pairs of like wall panels hingedly connected in said bottom panel and wherein each wall panel and said bottom panel are integrally hinged together so that the walls can be erected from a collapsed position to an upright position and vice versa, wherein complementary locking means are provided at adjacent edges of said first and second pairs of wall panels so that said side and end panels are mutually lockable, when the corners of the container are formed by putting the wall panels into an upright attitude, wherein said container is adapted to next in superposed relationship with respect to another like container when said containers are in collapsed condition so that the height of a stack of collapsed containers is minimized.

According to a feature of the invention, said panels may include features which protrude beyond the medial planes of said panels, said features being formed and positioned so as to permit nesting of superposed containers.

According to another feature of the invention, said locking means may comprise a retaining face provided by the panels of one pair of panels engagable with a retaining face provided by the panels of the other pair of panels to prevent collapse of said wall panels.

According to yet another feature of the invention, the retaining face of a panel of one pair of panels may be mutually engaged with the retaining face of a panel of the other pair of panels when the corners of the container are formed and locked thereby to prevent collapse of the containers.

According to another feature of the invention the retaining face of said panel may be provided by a rib adjacent an end face of that panel. In constructions where a rib is provided, the rib may be received in a channel provided by the said other panel, one face of the channel providing the retaining face of the other panel to prevent collapse of the one panel. Preferably, a releasable locking face is hinged to said other panel for engagement with the retaining face of said one panel to prevent collapse of the other panel. Preferably, the locking face is carried by a locking flap hinged to said other panel which locking flap is integral with other panel and forms a part of said retaining channel face when locked.

According to yet another feature of the invention, said locking face may comprise a rib extending perpendicularly from said locking flap.

According to a further feature of the invention, said locking rib and said one panel may comprise releasable complementary fastening means. Preferably, said complementary fastening means are a push-snap fit. Moreover, it is also preferred that said fastening means comprise complementary notches and page formed along the mating adjacent vertical edges of said first and second pairs of wall panels and which are hinged into engagement when the locking flap is engaged after said wall panels are put into their fully upright positions to form said box.

According to a still further feature of the invention, a secondary retaining face may be provided within the channel of said other panel to engage an end edge of said one panel within said channel.

According to yet another feature of the invention, said wall panels may be formed with integral handling recesses adjacent their uppermost ends.

According to a further feature of the invention the underface of said bottom panel of one container may be formed with locating means adapted to engage complementary locking means formed upon an uppermost rim of another like container, said complementary locating means being engagable to enhance secure stacking of those containers.

According to yet another feature of the invention, the complementary locating means formed upon said uppermost rim may be adapted to engage locating means provided on the underside of a lid so that the lid can be secured to close said container and wherein the upwardly exposed face of said lid also includes locating means adapted to be engaged by said locating means provided on the underface of the bottom panel of another like container thereby to enhance secure stacking of those containers.

According to a still further feature of the invention, said integral hinges between each wall panel and said bottom panel may be continuous along the length of the respective wall panel.

According to yet another feature of the invention, said container may be substantially sized to fit a standard European pallet measuring 1.2×0.8 m for return shipment when said container is in a collapsed substantially flat condition.

According to another aspect of the invention, there is provided a collapsible container for use in the shipping of goods which comprises a single mounding of a plastics material to form an open-topped box which comprises a bottom panel and first and second pairs of like wall panels hingedly connected to said bottom panel and wherein each all panel and said bottom panel and first and second pairs of like wall panels hingedly connected to said bottom panel and wherein each wall panel and said bottom panel are integrally hinged together so that the walls can be erected from a collapsed position to an upright position and vice versa, wherein complementary locking means are provided at adjacent edges of said first and second pairs of wall panels so that said side and end panels are mutually lockable, when the corners of the container are formed by putting the wall panels into an upright attitude, said locking means comprises a retaining face provided by the panels of one pair of panels engagable with a retaining face provided by the panels of the other pair of panels to prevent collapse of said wall panels, wherein the retaining face of said one panel is provided by a rib adjacent an end face of that panel and wherein a releasable locking face is hinged to said other panel for engagement with the retaining face of said one panel, said locking face being carried by a locking flap hinged to said other panel and forming a part of the retaining retaining face of said other panel when locked.

A collapsible container suitable for use as a fish box according to the invention, will now be described, by way of example, with reference to the accompanying drawings, in which.

Figure 1:
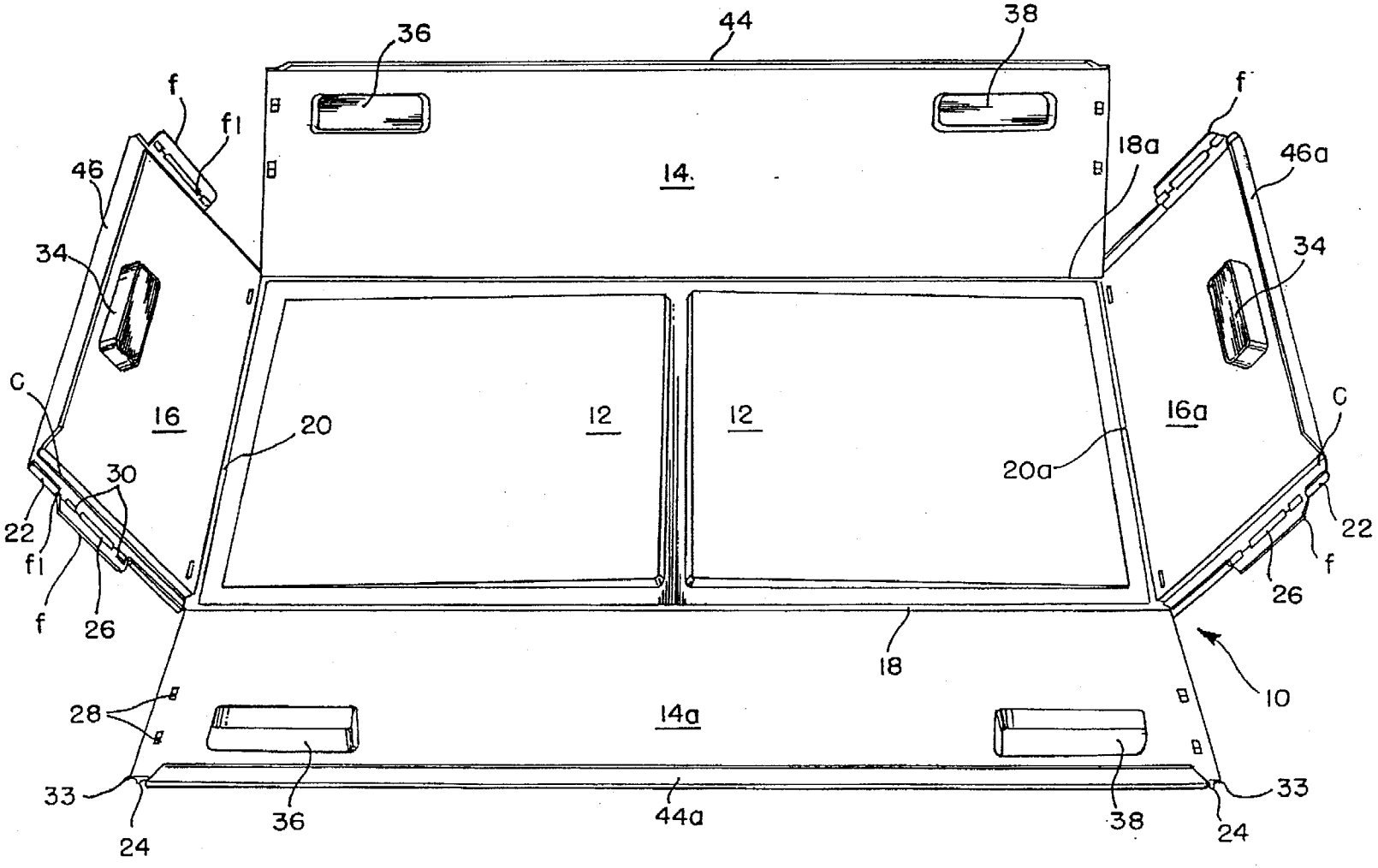
FIG. 1 is a plan view of a unitary blank of molded plastic material comprising a base panel and four integrally hinged wall panels from which the box can be formed, three of the wall panels being partly raised.
Figure 2:
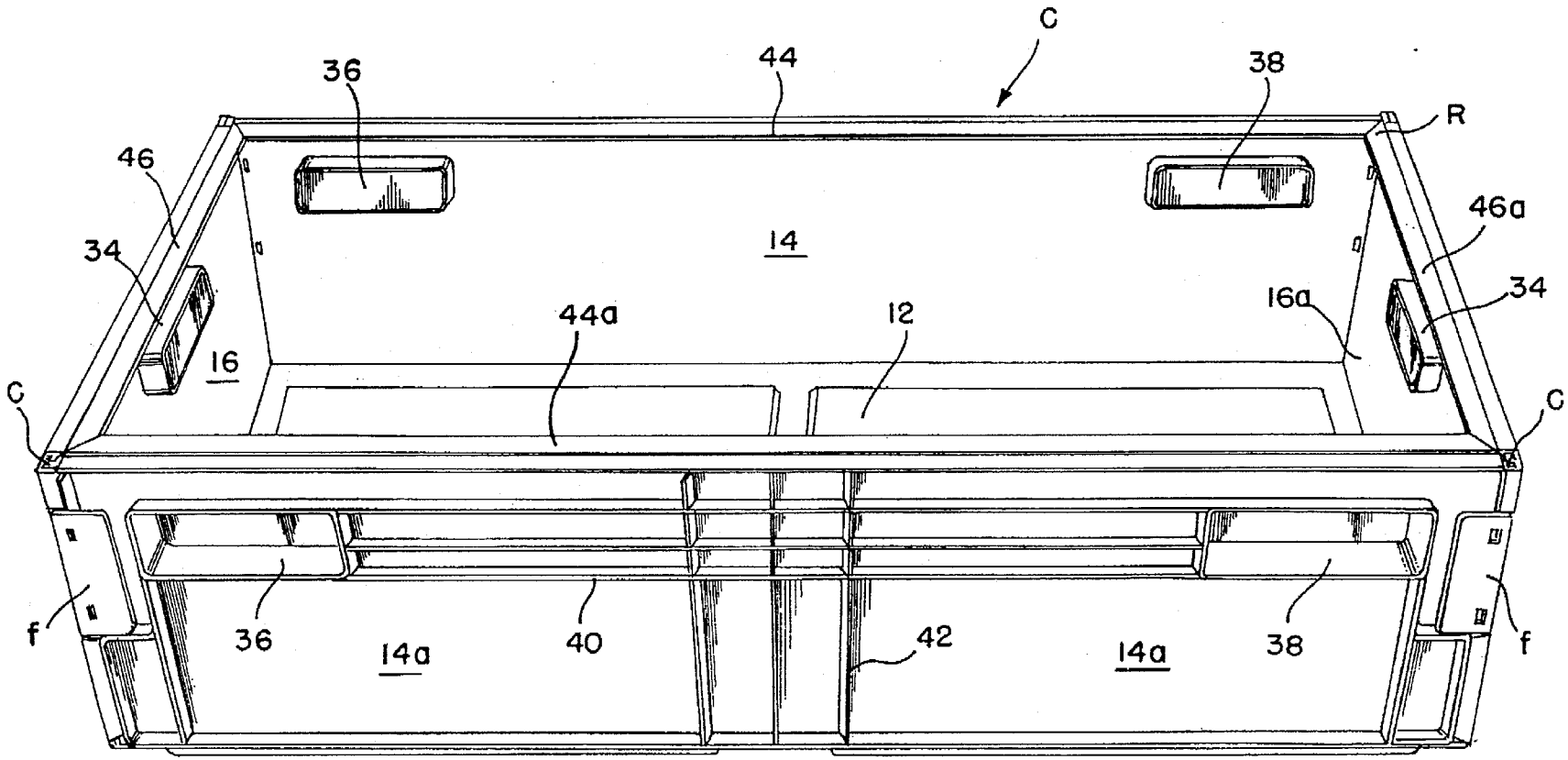
FIG. 2 is a perspective view of an erected open-topped container formed from the blank shown in FIG. 1.
Figure 3:
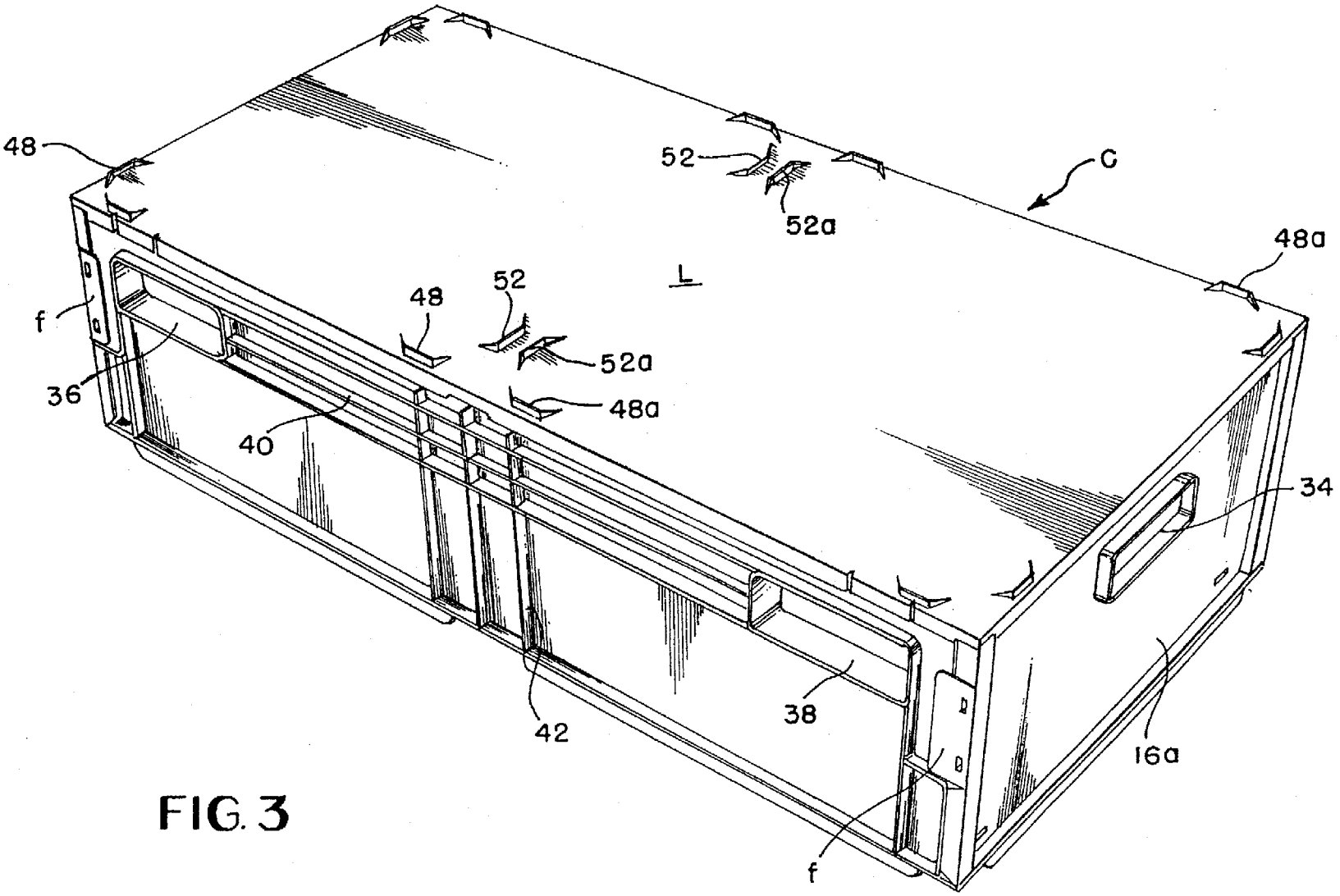
FIG. 3 is a perspective view of an erected open-topped container formed from the blank shown in FIG. 1 and also comprising a fitted lid.
Figure 4:
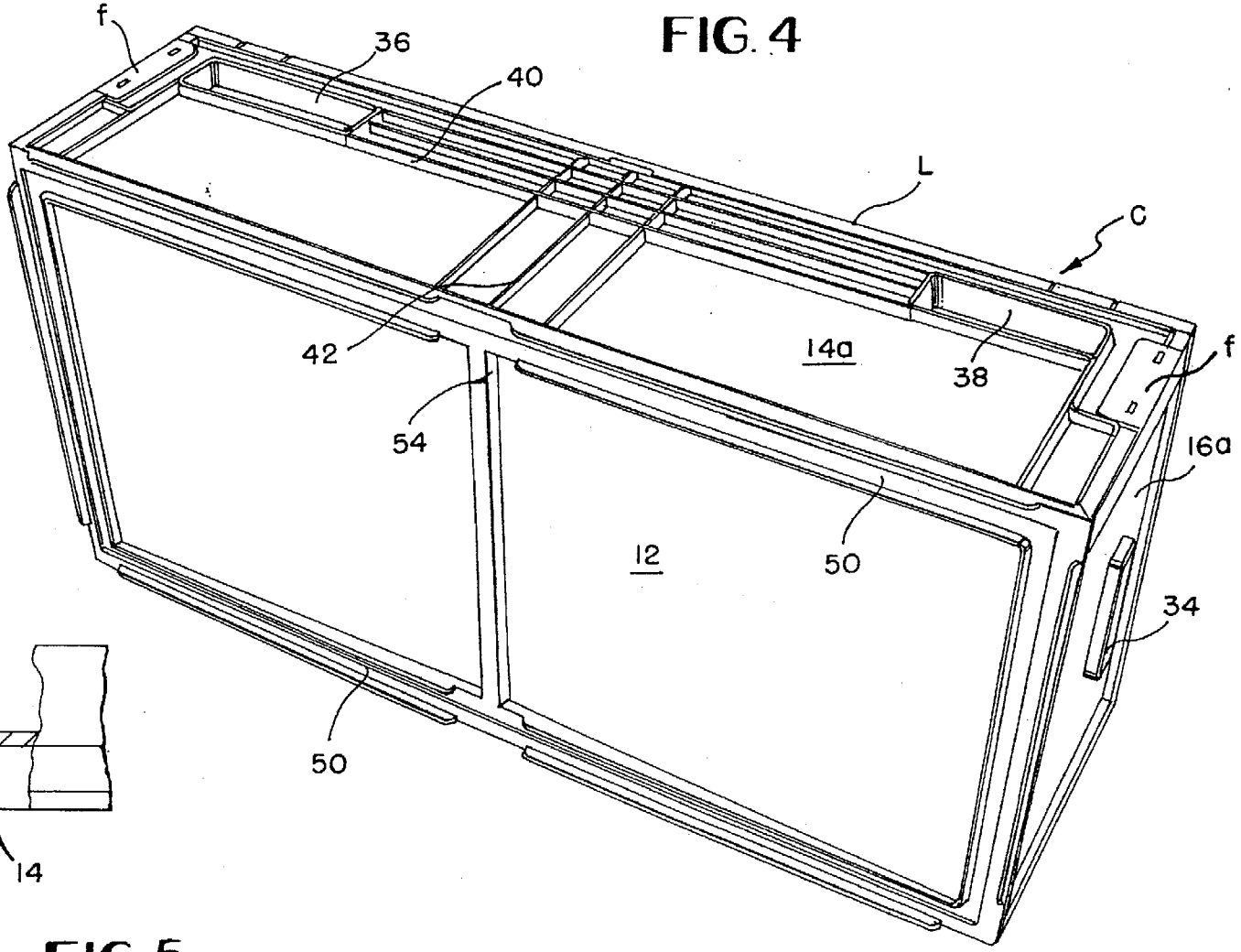
FIG. 4 is a perspective view of the container showing the underside of the base panel.

Referring first to FIG. 1, there is shown a unitary blank 10 of molded suitable plastic material comprising a rectangular bottom panel 12 to the peripheral edges of which are hinged first and second pairs, 14, 14*a* and 16, 16*a* respectively, of like wall panels side wall panels 14, 14*a* are hinged to the opposed longitudinal peripheral edges of bottom panel 12 along integral continuous hinges 18, 18*a* so that the wall panels can be erected from the collapsed position, in which they are substantially coplanar with the bottom panel, until they are upstanding substantially normal to the bottom panel, and vice versa. Likewise, end wall panels 16, 16*a* are hinged to the opposed transverse peripheral edges of bottom panel 12 along integral hinges 20, 20*a*.

Hinges 18, 18*a* and 20, 20*a*, sometimes referred to as "living hinges," comprise integrally molded continuous strips of plastics material which are molded together with the panels of the blank and are significantly thinner and hence more flexible than the wall thickness elsewhere in the blank. Although such continuous hinge strips will usually be formed from the material injected during the molding process to form the panels of the blank, other hinge constructions are envisaged.

Figure 5:
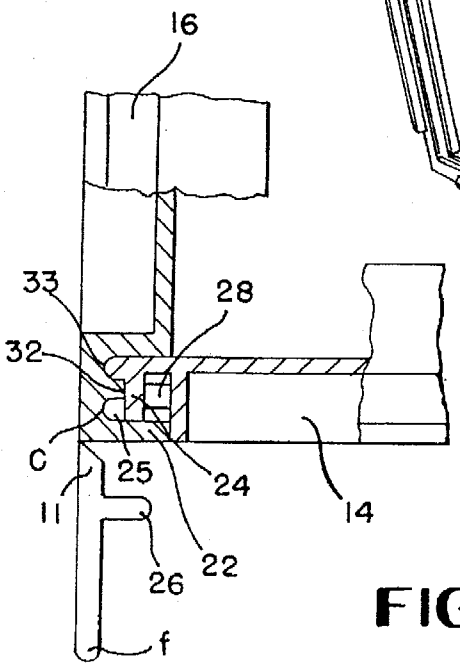
FIG. 5 is an end view showing the end wall panel along an edge with the locking flap in coplanar relationship with respect to the end wall panel.

Reference is now made to FIGS. 2 to 5. In order to maintain the wall panels upright to form the open topped container the side wall panels are locked to the end wall panels. To this end, the opposed vertical edges of the end wall panels are each provided with a locking flap "f" which engages the external face of a side wall and is locked to it in a snap-fit. Further, the vertical internal face of the end wall adjacent each end edge is formed with a channel "C," the outermost wall 22 of which provides a retaining face to prevent collapsing movement of the side walls, e.g. side wall 14 is furnished, adjacent its end edge, with an integral perpendicular flange or rib 24. When the end edge of side wall 14 is received in the channel "C", which occurs only when the corner of the container is properly formed by erecting the wall panels, rib 24 abuts the internal face 25 of channel wall 22 (FIG. 5). This abutment retains the side wall panel in its upright attitude and prevents it from collapse. Likewise rib 24 provides a retaining face to prevent collapse of end wall 16. However, in order to effectively engage rib 24 the locking flap "f" must be engaged. The arrangement at each end of the box is similar and therefore only one corner construction is described, it being understood that the description of the other corner constructions follow. Locking flap "f" is integrally hinged to the end edge of the end wall and includes a perpendicular locking rib 26. When the locking flap "f" is engaged it is folded into face contacting relationship with the external face of side wall panel 14. In so doing, the portion "f1" of the flap between channel wall 22 and locking rib 26 forms a part of the channel wall 22 and the locking rib 26 engages behind the rib 24. Thus, the mutual engagement between the ribs 24 and flap "f" prevent collapse of the end wall panel 16.

In order to achieve a positive fastening between the locking flap "f" and the side wall panel 14, the side wall is formed with a pair of spaced pegs 28 located behind rib 24. Page 28 locate as a "snap-fit" into spaced notches 30 formed in the locking rib 26.

A secondary locking rib 32 is formed within channel "C" against which the extreme end face 33 of the side wall panel engages and thereby gives better locking security and a more positive engagement of the wall panel edges when the corner of the container is being formed.

In order to facilitate handling of the box, the end walls are formed, adjacent their top ends with an inwardly projecting recess 34 which not only increases the vertical compression strength and the rigidity of the end wall but provides a handle feature for the end walls of the box. Similar handle recesses 36, 38 respectively, are formed in each of the side walls of the container, each recess 36 and 38 being separated by horizontal 40 and vertical 42 ribbing of the external face of the wall which improve the stiffness and stacking strength of the longer side wall panels.

Each of the wall panels includes an inwardly directed top flange 44, 44*a* and 46, 46*a*, respectively, which together form a raised upper rim R of the container when the wall panels are in their erected positions.

Top lid "L" (FIG. 3) has a peripheral complementary channel (not shown) which can be snap-fitted onto the raised rim R of the container. Around the edges on the top face of the lid "L" is formed a series of upstanding lips 46 and 48*a* and the underside of bottom panel 12 is formed, adjacent its periphery, with a peripheral channel 50 (FIG. 4) so that the lip of the lid "L" of an upper container can be located in the channel 50 of a lower container to facilitate locking and enhance stacking stability. Moreover, since the raised rim R around the top panel walls is vertically aligned with the channel 50 of a base, boxes can be stacked by engagement of the rim and channel one upon the next in the absence of lids so that only the top box of a stack need be lidded. The lid "L" also includes two pairs of transverse lips 52, 52*a* which are received in a relieved section 54 of the bottom panel of another like container. Lips 48, 52 and 48*a*, 52*a* so that each of those above groups engages and half of the bottom panel of a container stacked transversely thereon.

Figure 6:
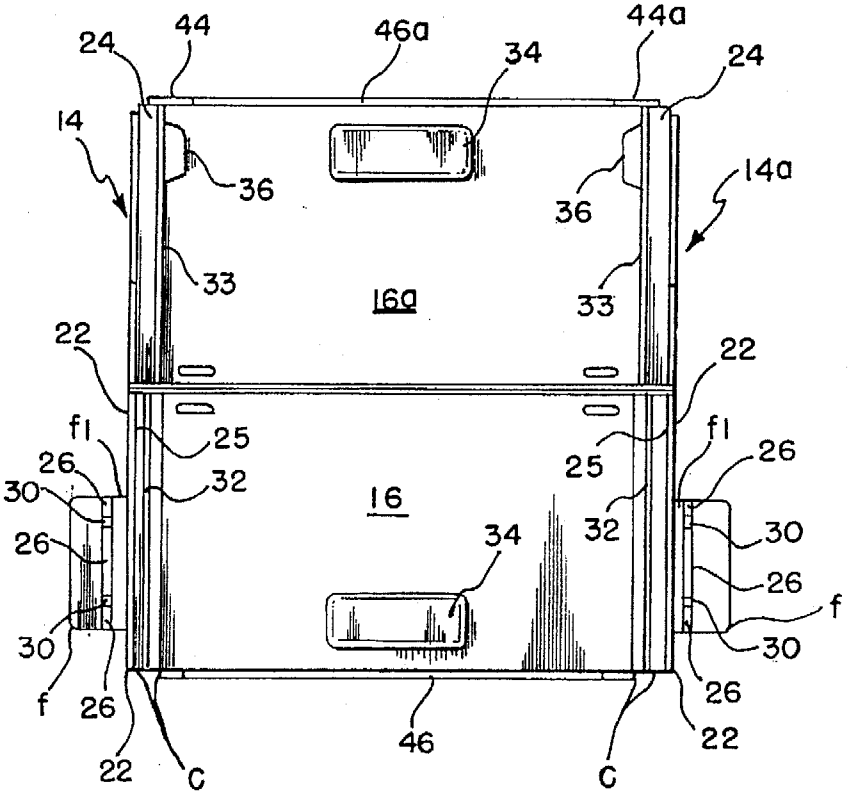
FIG. 6 is an end elevational view of a partially-erected open-topped container formed from the blank shown in FIG. 1, as viewed from an end of the container that has its end wall pivoted downward, further illustrating the elements shown in FIG. 5.

Referring now to FIG. 6, the alignment of some of the interlockable elements of the container shown in FIG. 6 and previous illustrations, is further illustrated in this end view of a partially-erected container. In FIG. 6, one end wall 16*a* and the two side walls have been erected. The container is viewed from an open end wherein the end wall 16 is pivoted downward. The manner in which the channel "C" formed at each end of the end wall 16 is aligned to receive the elements formed at the ends of the side walls 14, 14*a* is illustrated. When the end wall 16 is pivoted upward into adjoining relationship with the ends of the side walls 14, 14*a*, the innermost wall of each channel "C" receives the extreme face 33 of a respective side wall 14, 14*a*. At the same time, the internal face 25 of the outermost wall 22 of each channel "C" receives and abuts the edge of the perpendicular flange or rib 24 of each respective side wall 14, 14*a*. Also upon joining of the end 16 and side walls 14, 14*a*, the secondary rib 32 within each channel "C" is brought into abutting relationship with the outer surface of the perpendicular flange or rib 24 of each respective side wall 14, 14*a*.

Figure 7:
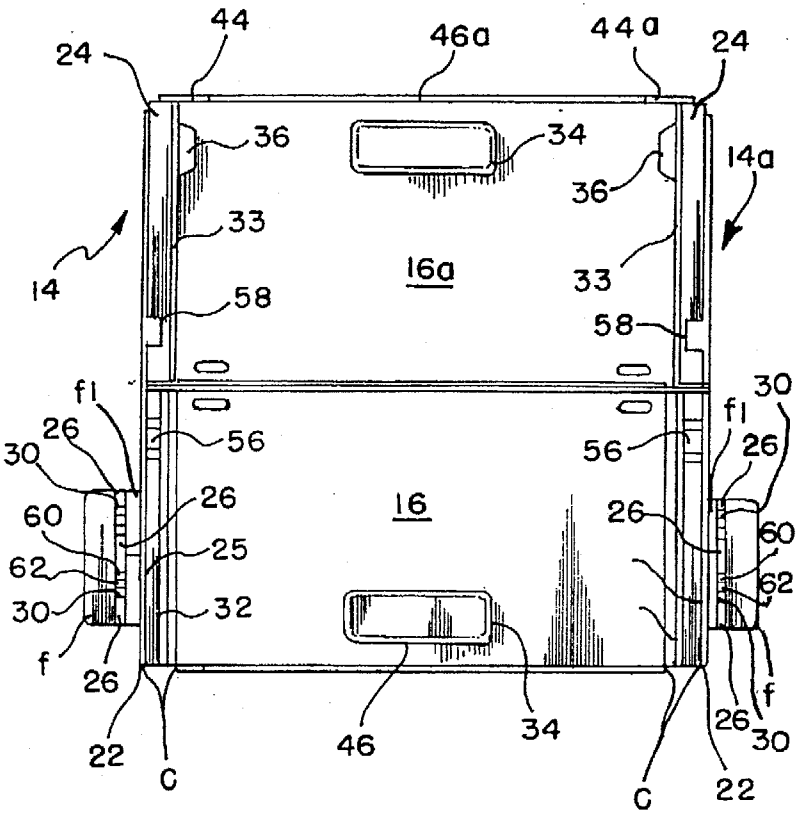
FIG. 7 is the same end elevational view of a partially-erected open-topped container as is illustrated in FIG. 6 but wherein the blank of FIG. 1 possesses additional elements.
Figure 8:
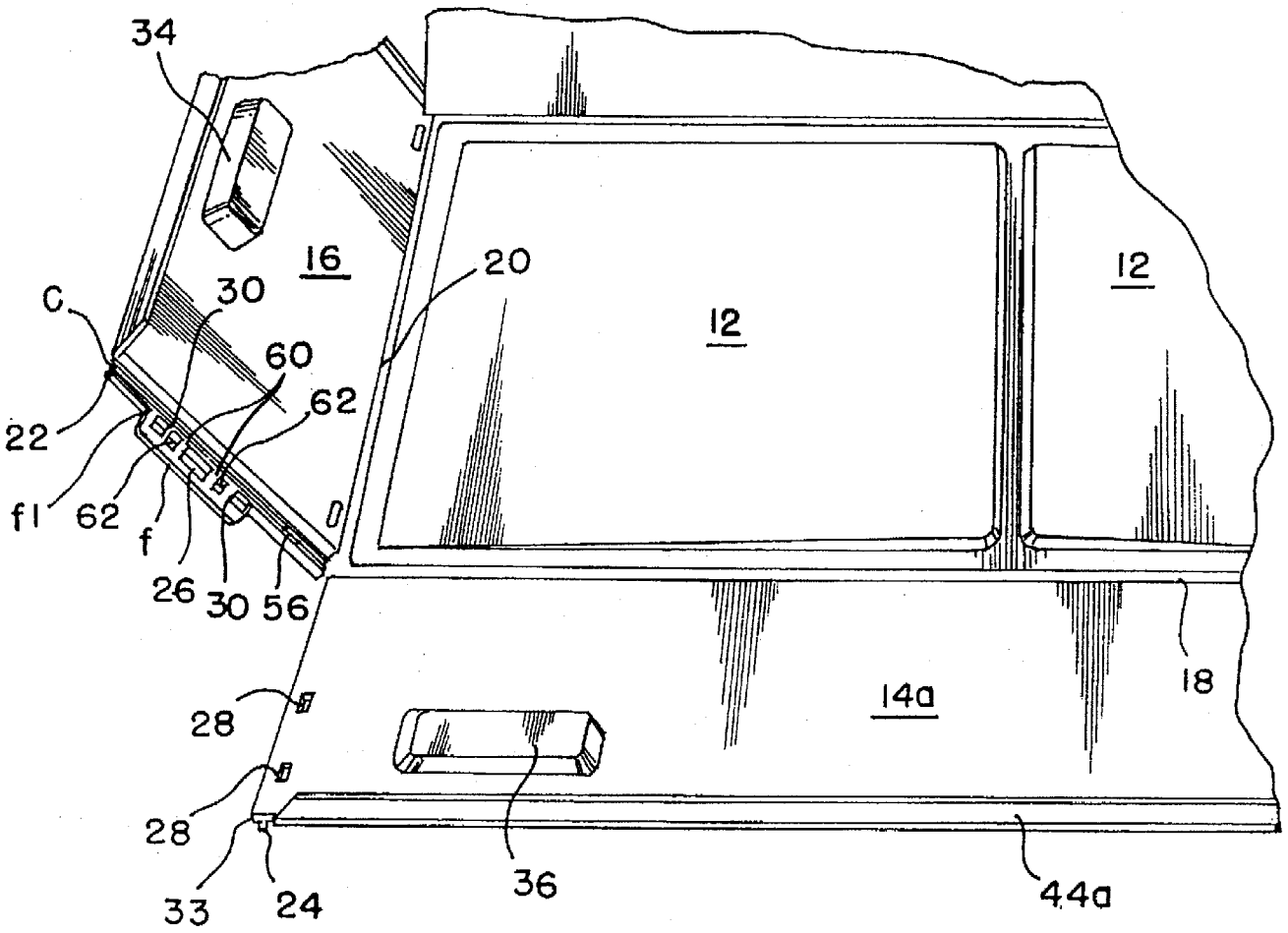
FIG. 8 is a perspective view of an open-topped container formed from the blank shown in FIG. 7.

Referring now to FIG. 7, which is the same and elevational view of a partially-erected container as is illustrated in FIG. 6, and, simultaneously, also referring to FIG. 8, additional elements of the container are illustrated. Proper alignment of the joining elements of the end wall 16 and side walls 14, 14*a* is promoted by means of a tab-like member 56 protruding from each channel "C" and a corresponding complementary notch 58, formed in each respective perpendicular flange or rib 24, for receiving the tab member 56. A tab member 56 and corresponding complementary notch 58 are formed and aligned to engage one another when the ends of end walls 14, 14*a* and side walls 16, 16*a* are brought into contact with one another. The tab member 56 is tapered, or bevelled, so that its narrowed leading end can easily engage the corresponding complementary notch 58. As the end wall 16, 16*a* is pressed against the side walls 14, 14*a*, each tab 56 is forced through a corresponding complementary notch 58 until the flared, or wider, portion of the tab member 56 extends into the complementary notch 58. It is the forcing of the flared tab member 56 through the complementary notch 58 which brings the edge of an end wall 14, 14*a* into desired alignment with the edge of a side wall 16, 16*a*.

An additional feature which is illustrated in FIGS. 7 and 8 is a modification of the perpendicular locking rib 26 of each flap "f." Each perpendicular locking rib 26 may be modified to facilitate engagement of each notch 30 in a locking rib 26 with a corresponding peg 28 (not visible in FIGS. 7 and 8 but previously discussed above). To alleviate any difficulty that might occur in engaging a notch 30 and corresponding peg 28 due to alignment variances cased during manufacture or continued use of the container, a secondary notch 60 is placed in the locking rib 26 near each notch 30 to form a secondary peg 62. The secondary peg 62 that is formed is flexible due to the notches 30, 60 on either side. The flexibility of the secondary peg 62 helps alleviate possible difficulty in snapping the pegs 28 into the notches 30 which may be caused by slight misalignment of the pegs 28 and respective notches 30. The use of the secondary peg 62 in the locking rib 26 greatly reduces or eliminates the rigidity and inflexibility of the locking rib 26 when optimum alignment between the pegs 28 and respective notches 30 does not occur.

The panels of the blank are configured so that a stack of blanks can be formed with the blanks disposed in superposed nested relationship. For instance, molded features of each panel are all contained with a common plane on either side of a medial plane of that panel. Also certain features are adapted to nest in other like features such as the handle recesses of the wall panels. When the box is collapsed, it is sized to be received upon a standard European sized pallet measuring 1.2×0.8 m for return shipment and refilling. For an outward journey, a pallet will receive three containers in each stacked tier of containers.

I claim:

1. A blank for a collapsible container formed from a single molding of plastics material and comprising a bottom wall, side- and end wall panels hinged to said bottom wall so that said wall panels can be erected from a collapsed to an upright position, and complementary locking means provided at adjacent end portions of said side- and end wall panels for securing said wall panels in upright position, said blank being adapted to be stacked unto like blanks for shipment and storage, characterized in that said wall panels include formations which project beyond the interior surfaces of said wall panels and corresponding recesses are provided on the exterior surfaces of said wall panels and arranged to receive said projecting formations of a like blank positioned below and in that at least certain of said formations provide handle means when said side- and end wall panels are in upright position.

* * * * *